US005745141A

United States Patent [19]

Miyawaki

[11] Patent Number: 5,745,141

[45] Date of Patent: Apr. 28, 1998

[54] RECORDING APPARATUS WITH SHEET DISCHARGING SECTION HAVING A SHEET DEFORMATION PREVENTION MECHANISM

[75] Inventor: Takako Miyawaki, Kawasaki, Japan

[73] Assignee: Canon Kabushiki Kaisha, Tokyo, Japan

[21] Appl. No.: 731,921

[22] Filed: Oct. 22, 1996

Related U.S. Application Data

[63] Continuation of Ser. No. 341,954, Nov. 16, 1994, abandoned, which is a continuation of Ser. No. 941,323, Sep. 4, 1992, abandoned.

[30] Foreign Application Priority Data

Sep. 5, 1991 [JP] Japan ..... 3-252741

[51] Int. Cl.[6] ..... B41J 2/01

[52] U.S. Cl. ..... 347/104; 271/278; 347/102

[58] Field of Search ..... 347/16, 102, 104; 271/226, 234, 236, 238, 278, 296

[56] References Cited

U.S. PATENT DOCUMENTS

| | | | |
|---|---|---|---|
| 2,937,021 | 5/1960 | Keil . | |
| 3,957,264 | 5/1976 | Bach et al. | 371/287 |
| 4,061,331 | 12/1977 | Habich . | |
| 4,197,045 | 4/1980 | Stauber . | |
| 4,717,926 | 1/1988 | Hotomi | 346/140 R |
| 4,728,963 | 3/1988 | Rasmussen et al. | 346/134 X |
| 4,830,358 | 5/1989 | Fazio et al. | 271/296 |
| 4,844,633 | 7/1989 | Greenberg . | |
| 4,874,160 | 10/1989 | Yamamoto | 271/234 X |
| 5,043,741 | 8/1991 | Spehrley, Jr. | 347/99 |

FOREIGN PATENT DOCUMENTS

| | | | |
|---|---|---|---|
| 0313203 | 4/1989 | European Pat. Off. . | |
| 59-190145 | 10/1984 | Japan | 346/134 |
| 63-144062 | 6/1988 | Japan . | |
| 63-147771 | 6/1988 | Japan . | |
| 63-196457 | 8/1988 | Japan | 346/134 |
| 2142879 | 1/1985 | United Kingdom . | |
| WO90 15770 | 12/1990 | WIPO . | |

*Primary Examiner*—John E. Barlow, Jr.
*Attorney, Agent, or Firm*—Fitzpatrick, Cella, Harper & Scinto

[57] ABSTRACT

The present invention relates to a recording apparatus for forming an image on a recording medium by discharging ink thereon and has a discharging section for receiving a recording medium discharged after an image has been formed thereon, and a deformation preventing member for preventing the recording medium discharged onto the discharging section from being deformed.

30 Claims, 5 Drawing Sheets

RECORDING APPARATUS WITH SHEET DISCHARGING SECTION HAVING A SHEET DEFORMATION PREVENTION MECHANISM

This application is a continuation of application Ser. No. 08/341,954 filed Nov. 16, 1994, now abandoned, which is a continuation of application Ser. No. 07/941,323 filed Sep. 4, 1992, abandoned.

BACKGROUND OF THE INVENTION

1. Field of the Invention

The present invention relates to a recording apparatus for forming an image by ejecting ink onto a recording medium, and more particularly to an improvement in a sheet discharging section for discharging recording sheets in an ink jet recording apparatus or the like.

2. Related Background Art

Conventionally, this type of ink jet recording apparatus comprises a sheet feeding section for feeding recording sheets, an image forming section for forming an image on a fed recording sheet by ejecting ink onto the recording sheet, and a sheet discharging tray for receiving the recording sheet discharged after the image has been formed thereon, wherein recording sheets fed from the sheet feeding section are discharged onto the sheet discharging tray with images formed thereon. However, since the discharged recording sheet is in a free state without being restricted at all on the sheet discharging tray, the recording sheet may roll while the ink ejected thereon dries, thereby incurring a problem that a high quality image cannot be produced.

SUMMARY OF THE INVENTION

The present invention has been made to solve the above-mentioned problem of the prior art, and its object is to provide a recording apparatus which is capable of preventing a recording medium discharged after an image has been formed thereon from being deformed, and thus resulting an image of high quality.

To achieve the above object, the present invention provides a recording apparatus for forming an image on a recording medium by ejecting ink thereon which comprises a discharging section for receiving a recording medium discharged after an image has been formed thereon, and a deformation preventing member for preventing deformation of the recording medium which is discharged onto the discharging section.

DETAILED DESCRIPTION OF THE PREFERRED EMBODIMENTS

Embodiments of the present invention will hereinafter be described in detail with reference of the accompanying drawings.

Figure 1:
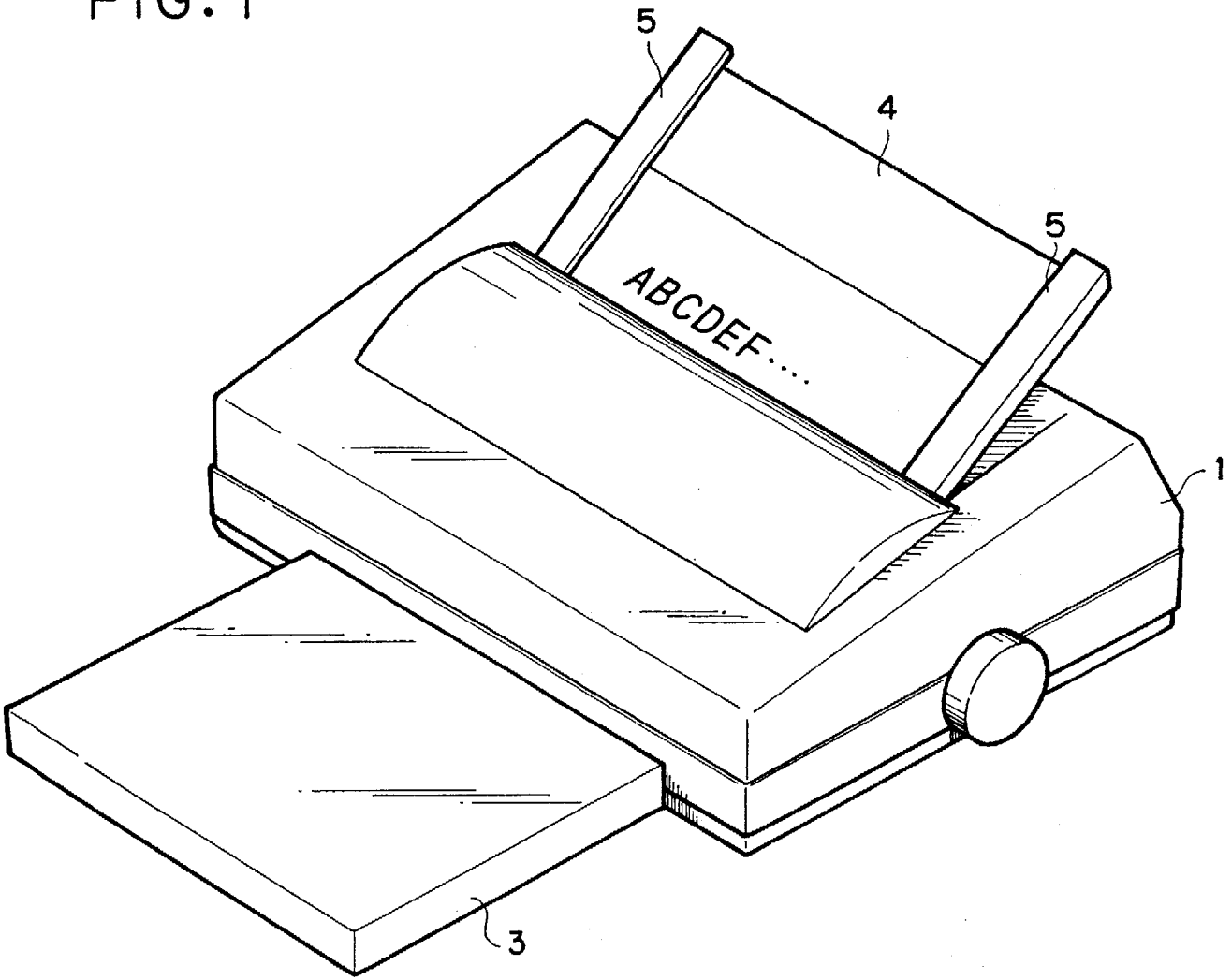
FIG. 1 is a perspective view showing the structure of an ink jet recording apparatus according to a first embodiment of the present invention.

FIG. 1 is a perspective view showing the structure of an ink jet recording apparatus according to a first embodiment of the present invention. Referring to FIG. 1, the ink jet recording apparatus 1 has a sheet feeding tray 3 for feeding recording sheets 2; a sheet discharging tray 4 for receiving a recording sheet which is discharged from an image forming section within the recording apparatus after being formed with an image; and deformation preventing members 5 for preventing the discharged recording sheet 2 from being deformed. The deformation preventing members 5 are arranged on both sides of the sheet discharging tray 4 for restricting the recording sheet 2.

On the recording sheet 2 in the sheet feeding tray 3, ink is ejected on its upper surface by the ink jet recording apparatus to form an image thereon, and the recording sheet 2 formed with an image is placed on the sheet discharging tray 4. While the drying ink on the surface tends to deform the recording sheet 2 on the sheet discharging tray 4 in a roll shape, the deformation preventing members 5 hold down both sides of the recording sheet 2, where the ink on the recording sheet 2 dries in such a held state, thereby preventing the recording sheet 2 from being deformed.

Figure 2:
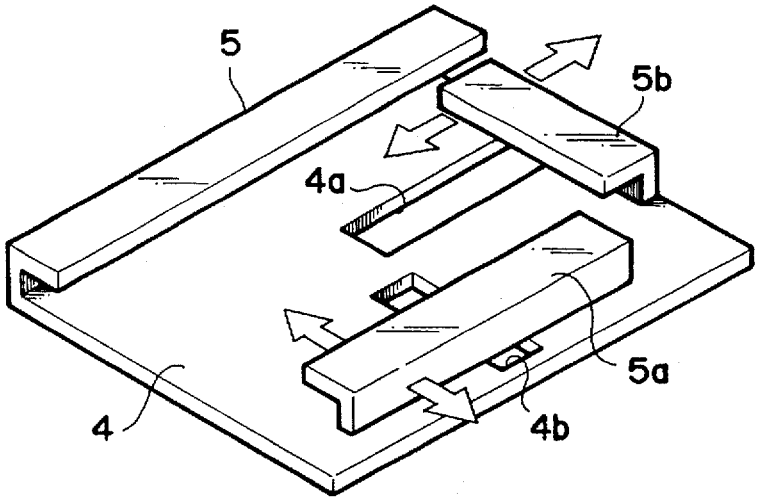
FIG. 2 is a perspective view showing the structure of a deformation preventing member provided for a recording apparatus according to a second embodiment of the present invention.

FIG. 2 shows the structure of a deformation preventing member for a recording apparatus according to a second embodiment of the present invention.

Referring to FIG. 2, reference numeral **5*a* designates a first L-shaped sliding member for preventing a recording sheet 2 from deformation in the horizontal direction, and 5*b* a second L-shaped sliding member for preventing the recording sheet 2 from deformation in the vertical direction. A sheet discharging tray 4 is formed with slits 4*a* and 4*b* corresponding to the horizontal and vertical directions of the recording sheet 2. The first and second sliding members 5*a* and 5*b* are each formed with a protrusion to engage with the slit 4*a* or 4*b*. As a result, the first and second sliding members 5*a*, 5*b*** are slidable in the horizontal and vertical directions (the directions indicated by the arrows in the drawing), respectively, in a manner that they can be adjusted according to the size of a recording sheet to be discharged.

Figure 3:
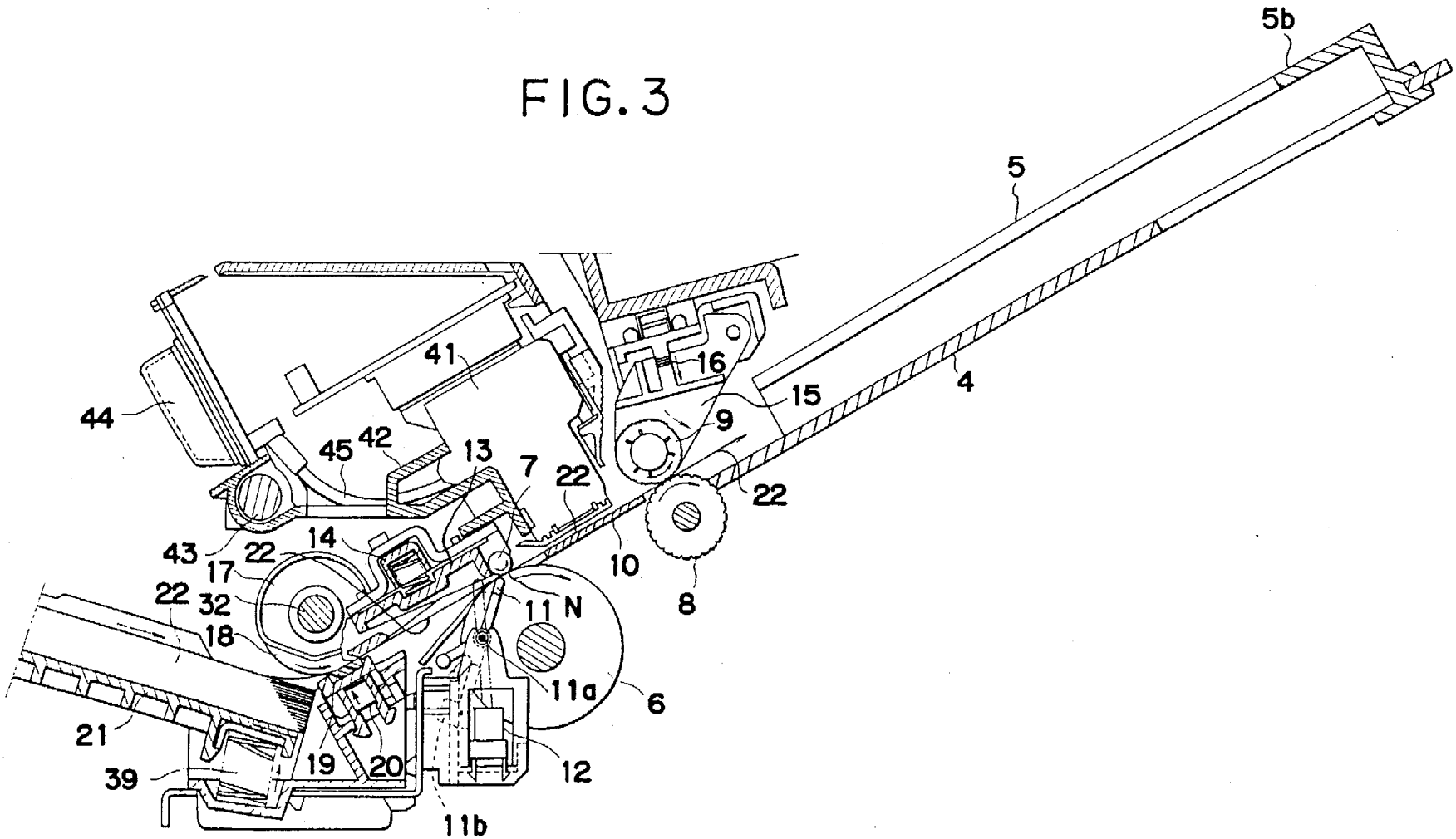
FIG. 3 is a cross-sectional view of the recording apparatus according to the second embodiment.

FIG. 3 is a cross-sectional view of an image forming apparatus in which the sheet discharging tray 4 of the second embodiment is implemented.

Reference numeral 41 designates an ink jet recording head, and 42 a carriage which carries this recording head 41. By driving this carriage 42 to travel along a carriage shaft 43 in a main scanning direction perpendicular to the sheet surface, the recording head 41 is moved for scanning in the main scanning direction. Reference numeral 44 designates an ink tank for storing ink which is discharged by the recording head 41. Ink in this tank 44 is supplied to the recording head 41 through an ink pipe 45.

Reference numeral 10 designates a paper guide (a platen plate) for defining a position at which printing is performed on a printing sheet (a printing section or sheet processing section). The recording head 41 faces this paper guide 10 with a small gap therebetween and moves for scanning in the main scanning direction along the paper guide 10. A sheet feeding stacker 21 is arranged in an oblique posture with its head directing downwardly and is always urged upwardly by a spring 39. Printing sheets 22 are stacked on this sheet feeding stacker 21 as sheets on which recording is to be performed.

Reference numeral 17 designates a semicircular sheet feeding roller (a first sheet transporting means), and 32 a sheet feeding roller shaft with which the sheet feeding roller 17 is integrated. Reference numeral 18 designates idle rolls which are arranged on both ends of the sheet feeding roller 17 and loosely fitted on the sheet feeding roller shaft 32. The diameter of this idle roll 18 is selected to be slightly shorter than the diameter of the sheet feeding roller 17. Reference numeral 19 designates a friction piece (friction pad) arranged below the sheet feeding roller 17, which is always urged upwardly by a spring 20 so that it is pressed against the lower surface of the idle roll 18 or an arc-shaped lower surface of the half-moon shaped sheet feeding roller 17 which is driven for rotation.

Reference numerals 6, 7 designate a pair of pressing rollers (a second sheet transporting means). The larger-diameter roller 6 on the lower side is a driving roller (hereinafter referred to as "transporting roller"), and the smaller-diameter roller 7 on the upper side is a dependent roller. The dependent roller 7 on the upper side is held by a holding member 13 which is urged by a spring 14 to be rotated toward the lower-side transporting roller 6, whereby the dependent roller 7 is pressed against the upper surface of the transporting roller 6. Reference numerals 8, 9 designate a pair of sheet discharging rollers. The roller 8 on the lower side is a driving roller, and the roller 9 on the upper side is a dependent roller. The dependent roller 9 is held by a holding member 15 which is urged by a spring 16 to be rotated toward the driving roller 8, thereby pressing the dependent roller 9 against the driving roller 8. Reference numeral 23 designates a sheet discharging stacker.

Reference numerals 11, 12 designate a sensor lever and a photosensor for detecting the top end and rear end of a transported printing sheet 22 passing in front thereof on the upstream side of a contact portion N of the pressing roller pair 6, 7 (the second sheet transporting means) in the printing sheet transporting direction.

During waiting for a sheet to be fed, the sheet feeding roller 17 has its semi-circular or arc-cutaway portion directed downwardly without being contacted with the friction piece 19 which is pressing against the lower surface of the idle roll 18.

In this sheet feed waiting state, when a sheet feed starting signal is transmitted to a control system (not shown), the sheet feeding roller 17 starts rotating in the forward direction, and the transporting roller 6 and the sheet discharging roller 8 also start rotating in the forward direction. Also, the sheet feeding stacker 21 is lifted by the spring 39, the upper surface of the stacked sheets 22 on the top side is pressed against the arc-shaped peripheral surface of the sheet feeding roller 17, and the topmost one on the stacked sheets 22 is picked up and transported by the subsequent rotation of the sheet feeding roller 17.

The sheet thus picked up and transported enters between the sheet feeding roller 17 and the friction piece 19. In this event, even if more than two sheets are transported, those other than the topmost sheet are prevented by the friction piece 19 from passing between the sheet feeding roller 17 and the friction piece 19, whereby the topmost sheet alone is separated from other sheets and allowed to pass between the sheet feeding roller 17 and the friction piece 19. After the top edge of the sheet has entered between the sheet feeding roller 17 and the friction piece 19, the sheet feeding stacker 21 is pushed down and held at a predetermined pause position against the spring 39, thereby releasing a sheet pressing force acting to the sheet feeding roller 17 by the spring 39.

When the sheet 22 is transported by the subsequent rotation of the sheet feeding roller 17 and the top edge of the sheet reaches near the contact portion N of the transporting roller 6 and the dependent roller 7, the sensor lever 11 is pushed by the top edge of the transported sheet 22 to pivot on a shaft **11*a* in the clockwise direction, whereby a light shielding flag 11*b* is removed from a light path of the photo sensor 12, and accordingly the light path is made open. The sensor 12 is thus turned on to inform the control system of the arrival of the sheet top edge at the sensor position. A timer circuit in the control system is started by this detection signal. The sheet is continuously transported, and the top edge thereof smoothly enters the contact portion N between the transporting roller 6 and the dependent roller 7 and passes therethrough. The sheet feeding roller 17, at the time it has rotated once, is stopped. Although the rotation of the sheet feeding roller 17 is stopped, the sheet 22 is continuously transported by the transporting roller 6 rotating in the forward direction, while the idle roll 18 of the sheet feeding roller 17 also rotates following the sheet transportation until the rear edge of the sheet 22 has passed the sheet feeding roller 17**.

In this embodiment, since the recording apparatus is of a serial type, the sheet transportation is executed until the top edge of a sheet reaches a predetermined printing position, and then stopped. Afterward, the sheet transportation is controlled such that the sheet is intermittently fed to the printing section 41, 10 by one printing line portion at a time, and printing in a serial method is successively executed on the transported sheet 22 by the recording head 41. The sheet, after having passed the printing section 41, 10, is discharged onto the sheet discharging stacker 4 by the sheet discharging rollers 8, 9.

When the rear edge of the transported sheet 22 has passed, the sensor lever 11 is released from the contact with the sheet 22 and pivots to restore its standing state, whereby the light path of the photo sensor is blocked by the shielding flag **11*b***, the passage of the rear edge of the sheet is detected, and a signal indicative of that is inputted to the control system.

After executing printing on the first transported paper 22 and discharging it to the sheet discharging stacker 4, similar control and operation are again repeated to execute the sheet transportation and printing on the second, third, . . . , sheets.

Figure 4:
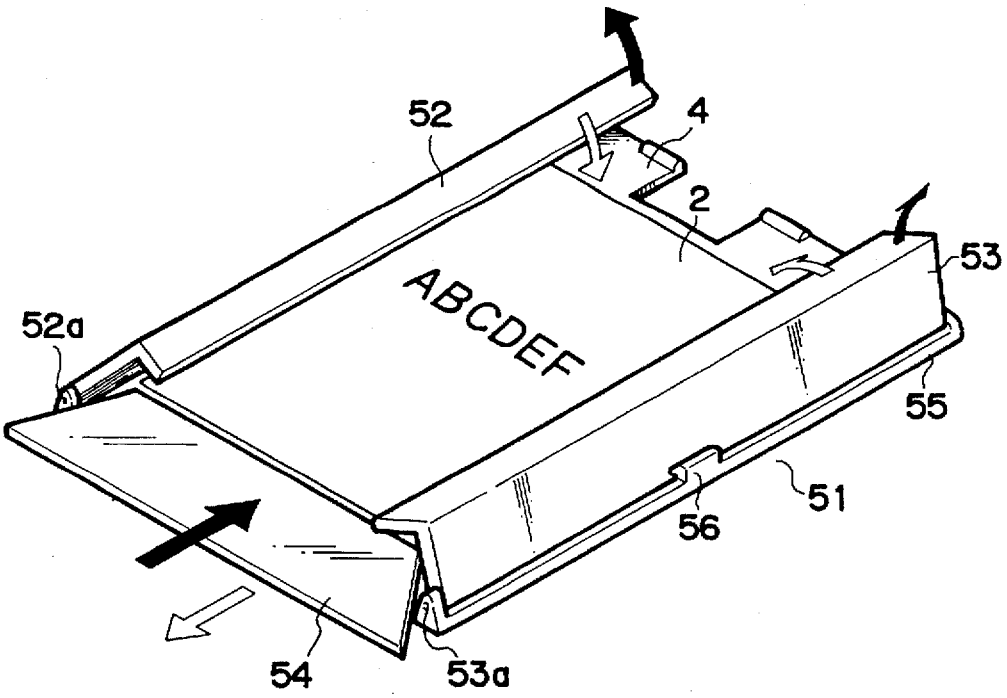
FIG. 4 is a perspective view showing the structure of a deformation preventing member provided for a recording apparatus according to a third embodiment of the present invention.

FIG. 4 is a perspective view showing the structure of a deformation preventing member for a recording apparatus according to a third embodiment of the present invention.

A deformation preventing member 51 of this embodiment has a pair of pivoting members 52, 53 and a sliding member 54. The pivoting members 52, 53 each are formed in an L-shape and pivotably mounted on pivot shafts **52*a*, 53*a*, respectively, on both side of the sheet discharging tray 4 (along the sheet discharging direction) such that their recessed surfaces face with each other. On the inner surface of each of the pivoting members 52, 53 there is connected one end of a coiled spring 55, the other end of which is connected to the sheet discharging tray 4. Pawls are formed for preventing the pivoting members 52, 53** from pivoting over a predetermined angular distance.

The sliding member (third sliding portion) 54 comprises a plate member which is tapered toward the top edge thereof, and is mounted on the sheet discharging tray 4 in a manner that the tapered top edge can be inserted into a space defined by the recessed surface of the pivoting members 52, 53. When this sliding member 54 is inserted toward the pivoting members 52, 53 (a second direction), since the width of the sliding member 54 gradually extends, the pivoting members 52, 53 in contact therewith start pivoting against urging force of the coiled springs 55 in conformity with the shape of the sliding member 54. The pivoting members 52, 53 are brought into contact with the pawls 56 when the sliding member 54 is inserted to some degree, and held at those positions without further pivoting action. On the other hand, when the sliding member 54 is drawn from the pivoting members 52, 53 (moved in a first direction), that is, when it is moved to the front side of the drawing, the pivoting members 52, 53 pivot toward the sheet discharging tray 4 by the urging force of the coiled spring 55 to be returned to the original positions.

With the above-mentioned structure, when the pivoting members 52, 53 are lifted by the movement of the sliding member 54, that is, when they are at a releasing position, a discharging recording sheet 2 is placed on the sheet discharging tray 4. Afterward, when the sliding member is returned to the original position, the pivoting members 52, 53 are inclined toward the recording sheet 2 by urging force of the coiled springs 55, whereby the recording sheet 2 is held down to prevent the deformation thereof.

Figure 5A:
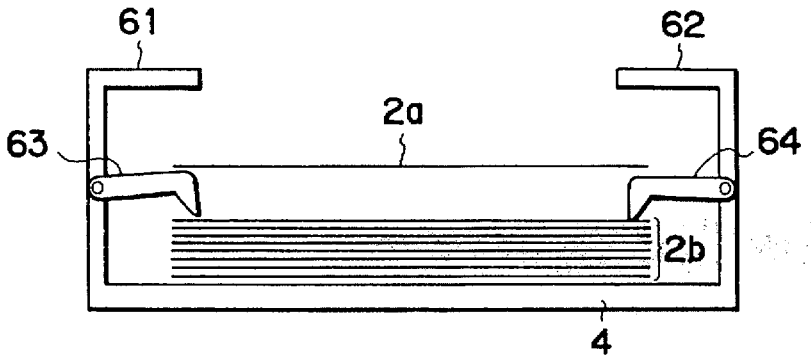
FIGS. 5A, 5B and 5C are cross-sectional views showing the structure of a deformation preventing member provided for a fourth embodiment of the present invention.
Figure 5B:
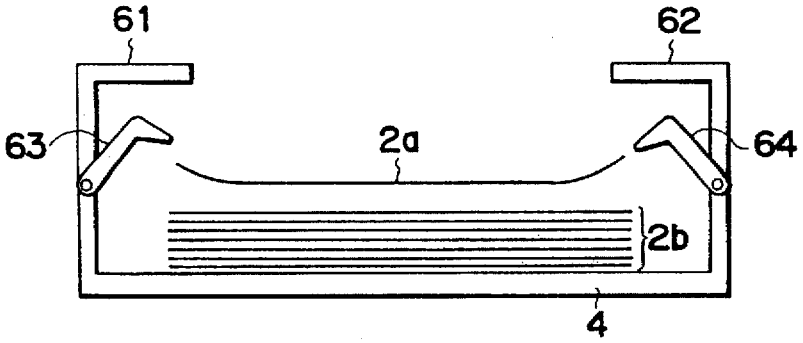
Figure 5C:
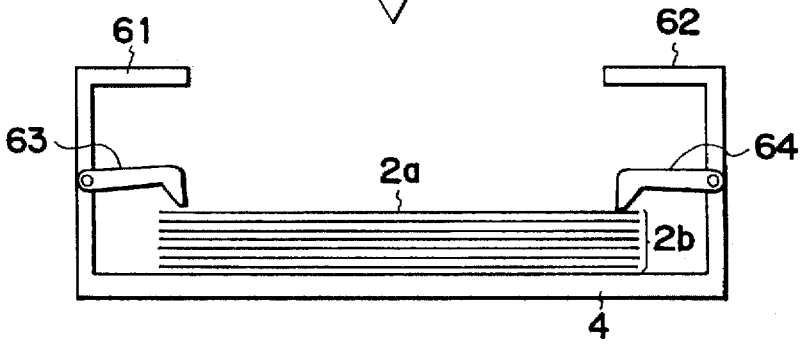

FIGS. 5A–5C are cross-sectional views showing a schematic structure of a deformation preventing member for a recording apparatus according to a fourth embodiment of the present invention.

In this embodiment, a sheet discharging tray 4 comprises a box-like member which has an open surface. On this open face there are formed a pair of inwardly protruding members 61, 62. On the side walls of the sheet discharging tray 4 there are mounted a pair of pivoting members 63, 64 which protrude inwardly and have a top end portion thereof bent in a V shape. FIG. 5A shows a state where discharged recording sheets 2*b* have already been placed on the sheet discharging tray 4 and are held by the top end of the pair of pivoting members 63, 64. On top of the pair of pivoting members 63, 64 there is placed a recording sheet 2*a* which is being discharged or has just been discharged. Next, as shown in FIG. 5B, the pivoting members 63, 64 are rotated upwardly and their top end portions are lifted, whereby the recording sheet 2*a* drops on the recording sheet stack 2*b*. Then, as shown in FIG. 5C, by returning the pivoting members 63, 64 to the original positions, the recording sheet 2*a* is held down to prevent deformation thereof. This embodiment is particularly effective in a case where recording is performed successively on a plurality of recording sheets. Incidentally, the pivoting movement of the pivoting members 63, 64 may be implemented by the sliding member 54 of the foregoing third embodiment.

What is claimed is:

1. A recording apparatus for forming an image on a recording medium, said apparatus comprising:

a discharging section for receiving a sheet of the recording medium discharged after an image has been formed thereon; and deterring means, opposed to at least a side of the sheet discharged to said discharging section, for deterring the sheet of the recording medium from warping due to image formation on the sheet, wherein said deterring means prevents warping of the recording medium by abutting an upper surface of the sheet of the recording medium discharged to said discharging section.

2. A recording apparatus according to claim 1, wherein said deterring means comprises a sliding member for preventing warping of the sheet of the recording medium in a vertical direction, said sliding member being movably mounted with respect to said discharging section, the vertical direction being a direction perpendicular to a bottom plane of said discharging section.

3. A recording apparatus according to claim 1, further comprising recording means, wherein recording onto the recording medium is effected by ink from said recording means.

4. A discharge sheet holding apparatus comprising:

a tray for holding a discharged sheet; and deterring means for deterring floating-up of the discharged sheet by abutting an upper surface of the discharged sheet held by said tray, wherein said deterring means is shiftable to a first position to abut the discharged sheet on said tray, or a second position not to abut the discharged sheet, said deterring means is pivotally supported by a supporting portion located adjacent a side of the discharged sheet to shift to the first or second position by pivoting, a sheet being correctly discharged is delivered on said deterring means positioned in the first position, and is dropped on said tray by pivoting said deterring means to the second position.

5. A discharge sheet holding apparatus according to claim 4, wherein the currently discharged sheet is delivered onto said tray with an image formed on an upper surface of the sheet.

6. An image forming apparatus comprising:

image formation means for forming an image on a sheet;

discharge means for discharging the sheet onto which the image is formed with said image formation means;

support means for supporting the sheet discharged by said discharge means; and deterring means for deterring warping of the sheet due to image formation thereto, said deterring means deterring the warping by urging against an upper surface of the sheet discharged to said sheet support means.

7. An image forming apparatus according to claim 6, wherein said deterring means comprises an abutting member for abutting against a surface of a last-discharged sheet at least until a next sheet is discharged to said support means.

8. An image forming apparatus according to claim 7, wherein said abutting member is shiftable to a first position abutting the last-discharged sheet on said support means, or a second position not abutting the last-discharged sheet on said support means.

9. An image forming apparatus according to claim 8, wherein said abutting member is rockably supported to be shifted to the first position or the second position.

10. An image forming apparatus according to claim 8, wherein said discharge means discharges the next sheet onto said abutting member when in the first position.

11. An image forming apparatus according to claim 10, wherein the last-discharged sheet is placed onto said support means by, after the last-discharged sheet has been discharged onto said abutting member by said discharge means, shifting said abutting member to the second position.

12. An image forming apparatus according to claim 6, wherein said deterring means deters warping of a side periphery of the sheet discharged.

13. An image forming apparatus according to claim 6, wherein said image forming means forms the image on the sheet by discharging ink.

14. A discharge sheet holding apparatus comprising:

a tray for holding a discharged sheet; and a deterring member for deterring floating-up of the discharged sheet by abutting an upper surface of the discharged sheet held by said tray, wherein said deterring member is shiftable to a first position to abut the discharged sheet on said tray, or a second position not to abut the discharged sheet, said deterring member is pivotally supported by a supporting portion located adjacent a side of the discharged sheet to shift to the first or second position by pivoting, and a sheet being currently discharged is delivered on said deterring member positioned in the first position, and is dropped on said tray by pivoting said deterring member to the second position.

15. A discharge sheet holding apparatus according to claim 14, wherein the currently discharged sheet is delivered onto said tray with an image formed on an upper surface of the sheet.

16. An image forming apparatus comprising:

image formation means for forming an image on a sheet;

discharge means for discharging the sheet onto which the image is formed with said image formation means;

support means for supporting the sheet discharged by said discharge means; and a deterring member for deterring warping of the sheet due to image formation thereto, said deterring member deterring the warping by urging against an upper surface of the sheet discharged to said sheet support means.

17. An image forming apparatus according to claim 16, wherein said deterring member comprises an abutting member for abutting against a surface of a last-discharged sheet at least until a next sheet is discharged to said support means.

18. An image forming apparatus according to claim 17, wherein said abutting member is shiftable to a first position abutting the last-discharged sheet on said support means, or a second position not abutting the last-discharged sheet on said support means.

19. An image forming apparatus according to claim 18, wherein said abutting member is rockably supported to be shifted to the first position or the second position.

20. An image forming apparatus according to claim 18, wherein said discharge means discharges the next sheet onto said abutting member when in the first position.

21. An image forming apparatus according to claim 20, wherein the last-discharged sheet is placed onto said support means by, after the last-discharged sheet has been discharged onto said abutting member by said discharge means, shifting said abutting member to the second position.

22. An image forming apparatus according to claim 16, wherein said deterring member deters warping of a side periphery of the sheet discharged.

23. An image forming apparatus according to claim 16, wherein said image forming means forms the image on the sheet by discharging ink.

24. A recording apparatus for forming an image on a recording medium, said apparatus comprising:

a discharging section for receiving a sheet of the recording medium discharged after an image has been formed thereon; and a deterring member, opposed to at least a side of the sheet discharged to said discharging section, for deterring the sheet of the recording medium from warping due to image formation on the sheet, wherein said deterring member prevents warping of the recording medium by abutting an upper surface of the sheet of the recording medium discharged to said discharging section.

25. A recording apparatus according to claim 24, wherein said deterring member comprises a sliding member for preventing warping of the sheet of the recording medium in a vertical direction, said sliding member being movably mounted with respect to said discharging section, the vertical direction being a direction perpendicular to a bottom plane of said discharging section.

26. A recording apparatus according to claim 24, further comprising recording means, wherein recording onto the recording medium is effected by ink from said recording means.

27. A discharge sheet holding apparatus comprising:

a tray for holding a discharged sheet; and deterring means for deterring floating-up of the discharged sheet by abutting an upper surface of the discharged sheet held by said tray, wherein said deterring means is pivotally supported by a supporting portion located adjacent a side of the discharged sheet to be shiftable to a first position to abut the discharged sheet on said tray or a second position not to abut the discharged sheet, a sheet being currently discharged is delivered on said deterring means positioned in the first position and is dropped on said tray by pivoting said deterring means to the second position, the currently discharged sheet on said deterring means positioned in the first position is not contacted with the discharged sheet previously discharged and stacked on the tray.

28. A discharge sheet holding apparatus comprising:

a tray for holding a discharged sheet; and a deterring member for deterring floating-up of the discharged sheet by abutting an upper surface of the discharged sheet held by said tray, wherein said deterring member is pivotally supported by a supporting portion located adjacent a side of the discharged sheet to be shiftable to a first position to abut the discharged sheet on said tray or a second position not to abut the discharged sheet, and a sheet being currently discharged is delivered on said deterring member positioned in the first position and is dropped on said tray by pivoting said deterring member to the second position, the currently discharged sheet on said deterring member positioned in the first position is not contacted with the discharged sheet previously discharged and stacked on the tray.

29. A discharge sheet holding apparatus comprising:

a sheet discharging means for discharging sheets;

an image forming means disposed upstream of said sheet discharging means for forming an image on the sheets;

a tray for holding a discharged sheet discharged by said sheet discharging means; and deterring means for deterring floating-up of the discharged sheet by abutting an upper surface of the discharged sheet held by said tray, wherein said deterring means is pivotally supported by a supporting portion located adjacent a side of the discharged sheet to be shiftable to a first position to abut the discharged sheet on said tray or a second position not to abut the discharged sheet, a sheet being currently discharged is delivered on said deterring means positioned in the first position and is dropped on said tray by pivoting said deterring means to the second position, the currently discharged sheet on said deterring means positioned in the first position is not contacted with the discharged sheet previously discharged and stacked on the tray.

30. A discharge sheet holding apparatus comprising:

a sheet discharging means for discharging sheets;

an image forming means disposed upstream of said sheet discharging means for forming an image on the sheets;

a tray for holding a discharged sheet discharged by said sheet discharging means; and a deterring member for deterring floating-up of the discharged sheet by abutting an upper surface of the discharged sheet held by said tray, wherein said deterring member is pivotally supported by a supporting portion located adjacent a side of the discharged sheet to be shiftable to a first position to abut the discharged sheet on said tray or a second position not to abut the discharged sheet, and a sheet being currently discharged is delivered on said deterring member positioned in the first position and is dropped on said tray by pivoting said deterring member to the second position, the currently discharged sheet on said deterring member positioned in the first position is not contacted with the discharged sheet previously discharged and stacked on the tray.

* * * * *

UNITED STATES PATENT AND TRADEMARK OFFICE

CERTIFICATE OF CORRECTION

PATENT NO. : 5,745,141

DATED : April 28, 1998

INVENTOR(S) : TAKAKO MIYAWAKI

It is certified that error appears in the above-identified patent and that said Letters Patent is hereby corrected as shown below:

COLUMN 6:

Line 19, "correctly" should read --currently--.

Signed and Sealed this

Seventeenth Day of November, 1998

Bruce Lehman

*Attest:*

BRUCE LEHMAN

*Attesting Officer*

*Commissioner of Patents and Trademarks*